US009185776B2

(12) United States Patent
Ahern

(10) Patent No.: US 9,185,776 B2
(45) Date of Patent: Nov. 10, 2015

(54) USER-ACTUATED LIGHTING EFFECT DEVICE

(71) Applicant: Michael John Ahern, El Granada, CA (US)

(72) Inventor: Michael John Ahern, El Granada, CA (US)

(73) Assignee: Michael John Ahern, El Granada, CA (US)

( * ) Notice: Subject to any disclaimer, the term of this patent is extended or adjusted under 35 U.S.C. 154(b) by 89 days.

(21) Appl. No.: 14/030,927

(22) Filed: Sep. 18, 2013

(65) Prior Publication Data

US 2014/0077723 A1 Mar. 20, 2014

Related U.S. Application Data

(60) Provisional application No. 61/702,628, filed on Sep. 18, 2012.

(51) Int. Cl.

| | |
|---|---|
| ***H05B 37/02*** | (2006.01) |
| ***G10H 1/34*** | (2006.01) |
| ***G10H 1/00*** | (2006.01) |
| ***A63J 17/00*** | (2006.01) |
| ***F21V 23/04*** | (2006.01) |
| ***H05B 33/08*** | (2006.01) |

(52) U.S. Cl.

CPC ..... *H05B 37/0209* (2013.01); *A63J 17/00* (2013.01); *F21V 23/04* (2013.01); *G10H 1/00* (2013.01); *G10H 1/34* (2013.01); *G10H 1/348* (2013.01); *H05B 33/0863* (2013.01); *H05B 37/02* (2013.01); *H05B 37/029* (2013.01)

(58) Field of Classification Search

CPC ..... G10H 1/348; G10H 3/146; H05B 37/0209

USPC ..... 84/746; 315/299, 291

See application file for complete search history.

(56) References Cited

U.S. PATENT DOCUMENTS

| | | | | |
|---|---|---|---|---|
| 3,017,497 | A * | 1/1962 | Albright | F21V 23/04 200/86.5 |
| 4,121,488 | A | 10/1978 | Akiyama | |
| 4,167,783 | A * | 9/1979 | Mitchell | F21V 23/00 362/236 |
| 4,319,311 | A * | 3/1982 | Mitchell | F21V 23/00 362/249.09 |
| 5,347,431 | A * | 9/1994 | Blackwell | A61B 19/5202 362/11 |

(Continued)

FOREIGN PATENT DOCUMENTS

FR 2645770 A1 10/1990

OTHER PUBLICATIONS

American DJ Group of Companies Home Page Forum; forums.americandj.com; first post of Nov. 11, 2003, 9:37 p.m.;2 pgs.

(Continued)

*Primary Examiner* — Elvin G Enad
*Assistant Examiner* — Christina Schreiber
(74) *Attorney, Agent, or Firm* — Haynes Beffel & Wolfeld LLP; James F. Hann

(57) ABSTRACT

A user-actuated lighting effect device includes a housing, a light-generating lamp coupled to the housing, a power source, and a control circuit. The control circuit includes a user-actuated switch operably coupling the lamp and the power source. The lamp creates a lighting effect on or near the user when the first switch is on. The housing can be mounted in a use orientation on a pedal board. The lamp can create an upwardly directed lighting effect. An operational mode can be selected using a lighting mode switch.

6 Claims, 6 Drawing Sheets

(56) References Cited

U.S. PATENT DOCUMENTS 5,702,172 A * 12/1997 Kilburn ..... B62J 6/001 340/432
5,894,686 A * 4/1999 Parker ..... A43B 3/0021 36/137
6,215,055 B1 * 4/2001 Saravis ..... G10H 1/348 84/422.1
7,461,957 B2 * 12/2008 Thompson ..... F16M 11/10 248/121
7,563,972 B2 * 7/2009 Kubitz ..... G09B 15/00 84/464 A
7,824,052 B1 * 11/2010 Halm ..... A61B 19/5202 362/105
2004/0250673 A1 * 12/2004 Salerno ..... G10H 1/32 84/746
2005/0091884 A1 * 5/2005 Omstead ..... A43B 1/0036 36/137
2006/0032364 A1 * 2/2006 Ludwig ..... G10H 1/00 84/723
2007/0206375 A1 * 9/2007 Piepgras ..... A43B 1/0027 362/147
2007/0223239 A1 * 9/2007 Thompson ..... F16M 11/14 362/413
2007/0281811 A1 * 12/2007 Wang ..... A63B 43/06 473/570
2011/0088536 A1 * 4/2011 McMillen ..... G10H 1/348 84/746
2011/0095874 A1 * 4/2011 Bennett ..... G01H 1/0008 340/326
2011/0249425 A1 * 10/2011 Aurongzeb ..... F21V 14/02 362/102
2014/0301101 A1 * 10/2014 Russ ..... B60Q 1/44 362/520

OTHER PUBLICATIONS

MBT Lighting SCX101 16 Channel DMX Lighting Foot Controller; User Manual; in existance as of Nov. 25, 2011;21 pgs.

The Gear Page—Strobe Lights Controlled Via Foot Switch; www.thegearpage.net; Jan. 26, 2009, 8:34 p.m.;1 pg.

* cited by examiner

USER-ACTUATED LIGHTING EFFECT DEVICE

CROSS-REFERENCE TO OTHER APPLICATIONS

This application claims the benefit of U.S. Provisional Patent Application No. 61/702,628 filed on 18 Sep. 2012, which application is incorporated by reference as if fully set forth herein.

BACKGROUND OF THE INVENTION

This invention relates to the musical instrument accessory market. It finds particular utility when used with a pedal board.

Musical effect pedals, also referred to as effect pedals, or stompboxes, or audio effect pedals, are commonly used with electric guitars and other instruments to allow the performer to affect the sound of the music being played during the performance. One or more audio effect pedals are typically mounted to a pedal board. Pedal boards typically have an upwardly angled surface on which several audio effect pedals can be mounted, typically with the use of hook and loop fasteners, such as sold under the trademark Velcro®. Pedal boards also facilitate routing of cables and delivery of power to the various effect pedals. Electric guitar players, as an example, use individual assortments of audio effect pedals/stompboxes to create their individual sound. With rare exception, electrical guitar player and electric bass player "process" their audio signal with effect pedals/stompboxes during practice and performance.

BRIEF SUMMARY OF THE INVENTION

A user-actuated lighting effect device includes a housing, a light-generating lamp coupled to the housing, a power source, and a control circuit. The control circuit includes a user-actuated switch operably coupling the lamp and the power source, the switch placeable in an off state to electrically isolate the lamp from the power source and in an on state to electrically connect the lamp to the power source. The lamp creates a lighting effect on or near the user when the switch is in the on state. In some examples, the lighting effect device can include one or more the following. The housing can include pedal board attachment structure so the housing can be mounted in a use orientation on a pedal board. The lamp can be arranged and positioned to create an upwardly directed lighting effect. The switch can be a user-actuated foot switch on the housing.

A method for providing a performer with upwardly directed illumination can be carried out as follows. A foot-actuated lighting effect device is placed on a support surface at a location adjacent to an area where a performer will be during a performance. The foot-actuated lighting effect device includes a lamp for selectively creating an upwardly directed lighting effect on or near the performer, a lighting mode switch and a performer-actuated first foot switch. An operational mode is selected using the lighting mode switch. The foot switch is operated by the performer to selectively place the device in the selected operational mode. Some examples may include one or more of the following. A second foot switch can be operated by the performer to change the color of the light from the lamp. The mode switch can be used to allowing the performer to select at least the following operational modes: different colored lighting effects, a strobe lighting effect, a fader lighting effect, and a lighting effect affected by an audio signal. The placing step can be carried out with the lighting effect device being an integral part of a pedal board.

Other features, aspects and advantages of the present invention can be seen on review the drawings, the detailed description, and the claims which follow.

DETAILED DESCRIPTION OF THE INVENTION

Figure 1:
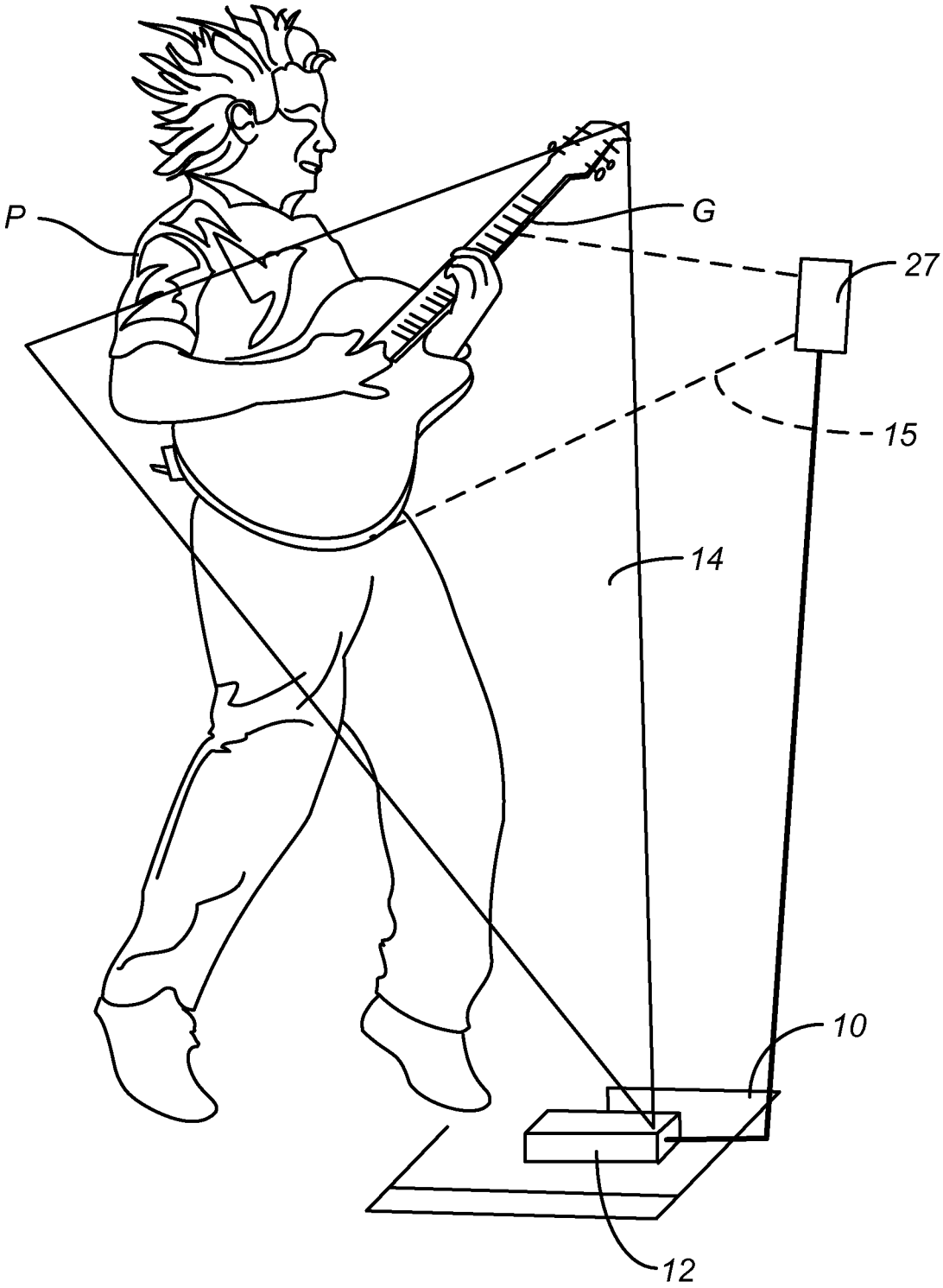
FIG. 1 is a simplified schematic view showing a performer with a guitar being illuminated by a lighting effect during a practice session or performance.

The following description will typically be with reference to specific structural embodiments and methods. It is to be understood that there is no intention to limit the invention to the specifically disclosed embodiments and methods but that the invention may be practiced using other features, elements, methods and embodiments. Preferred embodiments are described to illustrate the present invention, not to limit its scope, which is defined by the claims. Those of ordinary skill in the art will recognize a variety of equivalent variations on the description that follows. Unless otherwise stated, in this application specified relationships, such as parallel to, aligned with, or in the same plane as, mean that the specified relationships are within limitations of manufacturing processes and within manufacturing variations. When components are described as being coupled, connected, being in contact or contacting one another, they need not be physically directly touching one another unless specifically described as such. Like elements in various embodiments are commonly referred to with like reference numerals.

FIG. 1 is a simplified schematic view showing the performer P holding a musical instrument such as a guitar G during a practice session or performance. Performer P is shown standing next to a generally conventional pedal board 10 on which a lighting effect device 12, also referred to as a lighting effect pedal 12 or simply device 12, is mounted. FIG. 1 also schematically illustrates an upwardly directed lighting effect 14, emanating from a lamp 26, see FIG. 3, created by lighting effect device 12 under the control of performer P.

In some examples, lighting effect device 12 can also include a supplemental lamp 27. Supplemental lamp 27 can be electrically coupled to the housing 18 through an LED expansion socket 66 on the surface 22 of housing 20; see FIG. 3. Supplemental lamp 27 can also be, and typically is, under the control of performer P. Supplemental lamp 27 can be used to create a supplemental lighting effect 15 directed to, for example, the performer's instrument. Supplemental lighting effect 15 can be generated instead of or in addition to lighting effect 14. Supplemental lamp 27 can be supported by, for example, a microphone stand or a separate support structure can be provided for the supplemental lamp. Lamp 27 typically uses an LED array as a light source, with its own power supply and driver circuits, and mirrors the light from LED array 51 of lamp 26.

Figure 2:
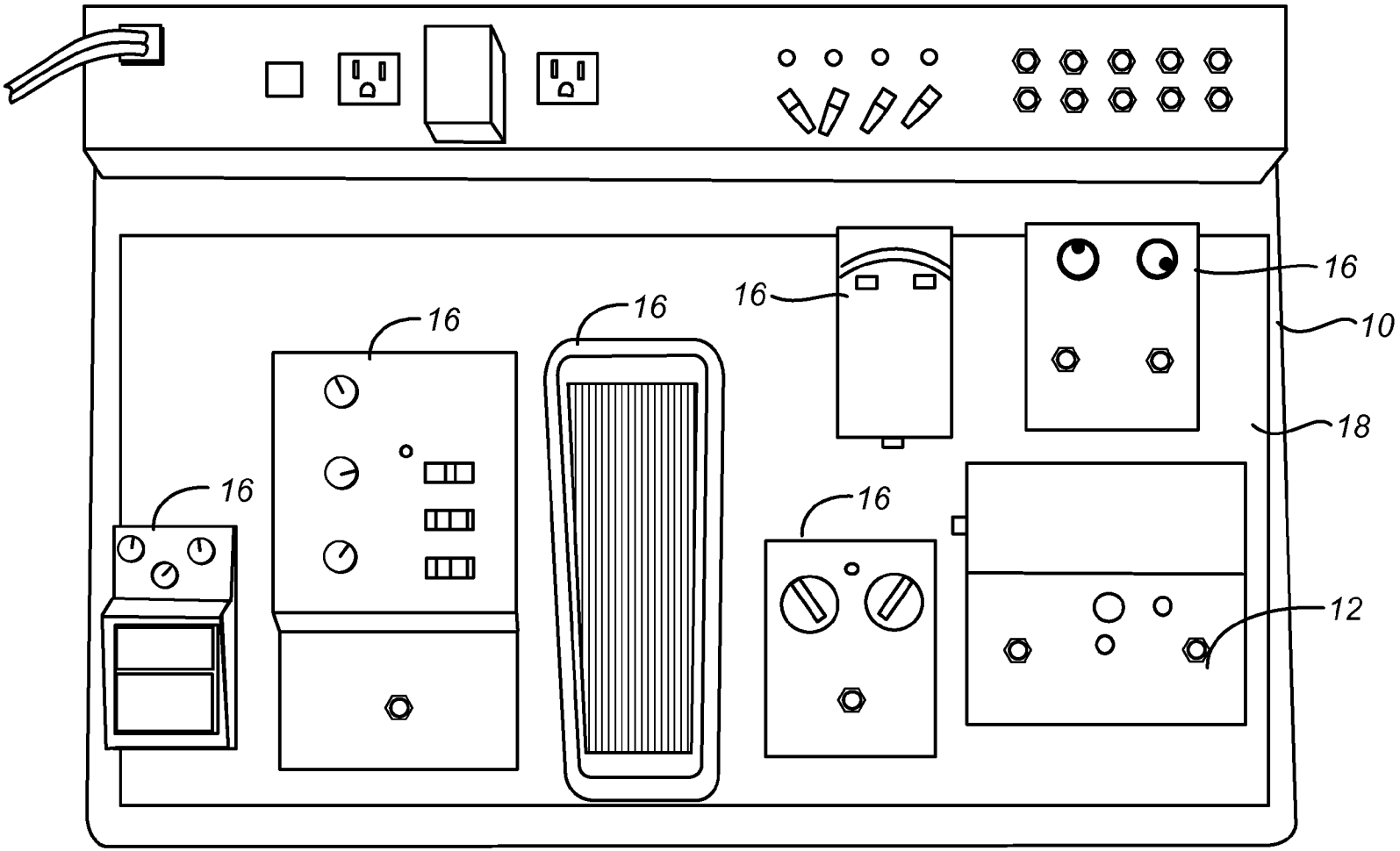
FIG. 2 is a simplified top plan view of a conventional pedal board having a number of conventional audio effect pedals and a lighting effect device mounted to its upper surface.

FIG. 2 is a simplified top plan view of a conventional pedal board 10 having a number of conventional audio effect pedals 16 mounted to its upper surface 18. In addition, a lighting effect device 12 is also mounted to upper surface 18.

Lighting effect device 12 is described primarily with reference to the performer being a musician. However, device 12 can also be used by, for example, singers, magicians, street performers, and other performers looking for a self-controlled, programmable, inexpensive, durable and easy to operate stage lighting solution.

Figure 3:
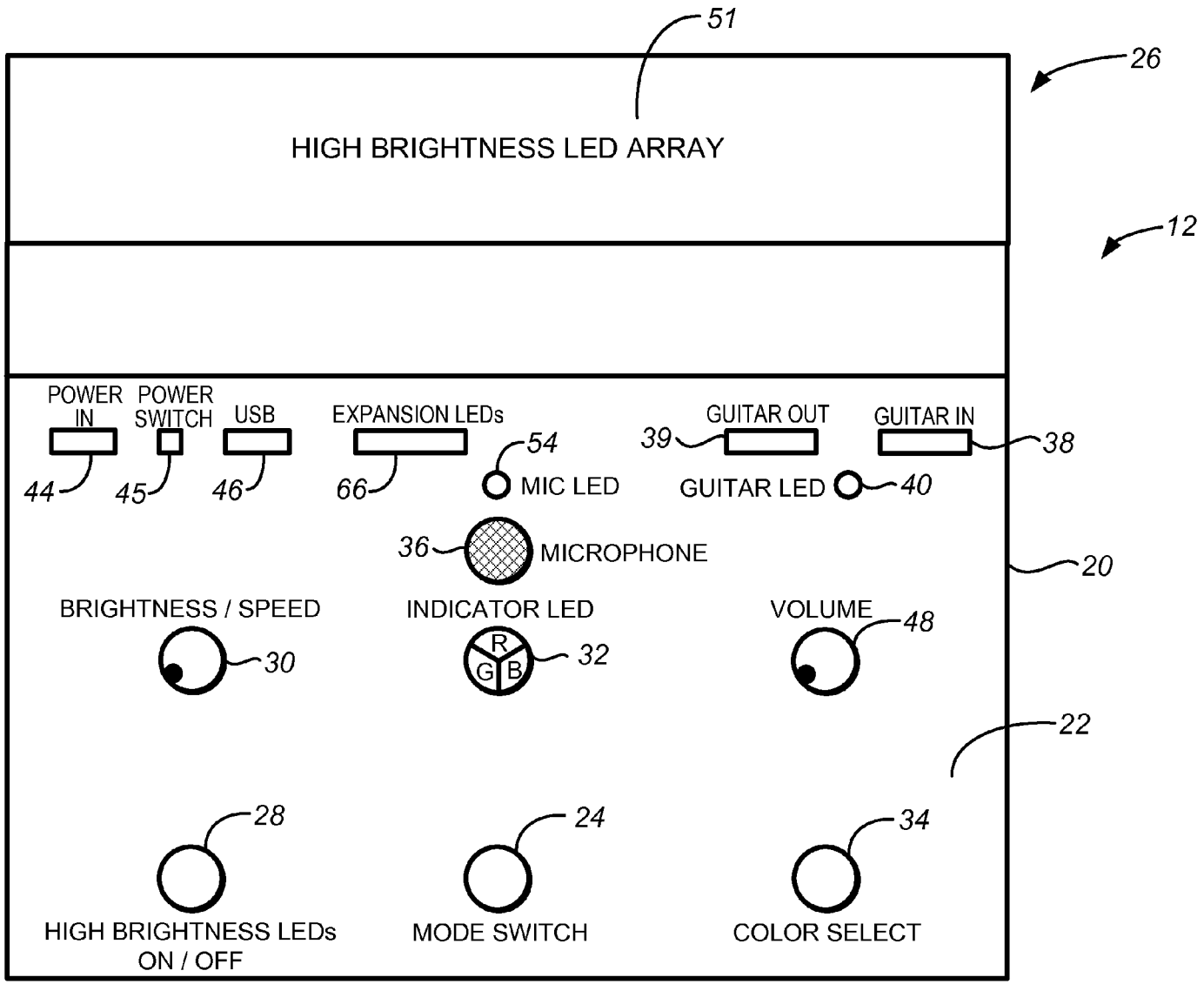
FIG. 3 is a simplified top plan view of the lighting effect device of FIG. 2.
Figures 4, 4A:
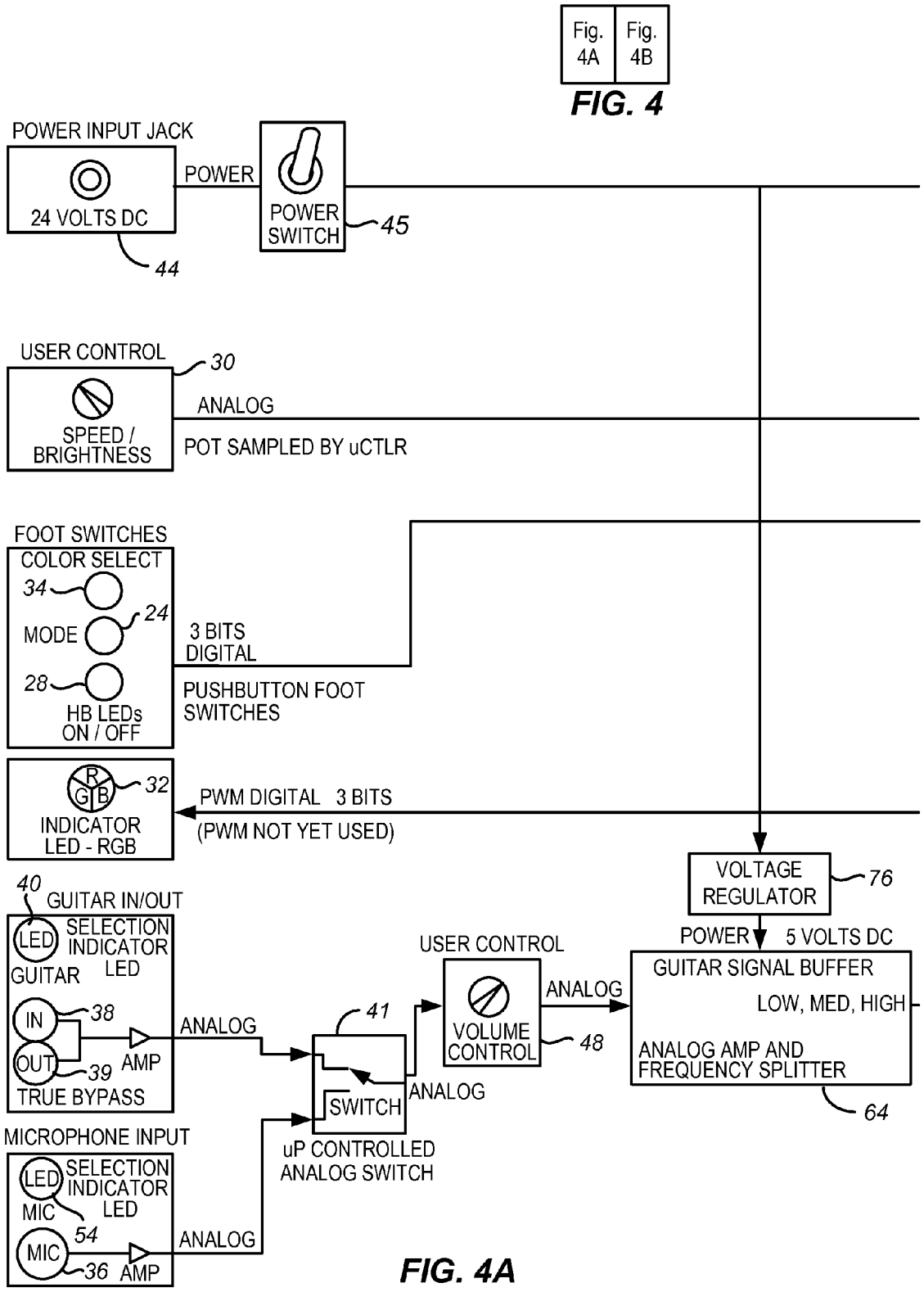
FIGS. 4A and 4B, which constitute
FIG. 4, are schematic diagrams illustrating the main components of the lighting effect device of FIG. 3.
Figure 4B:
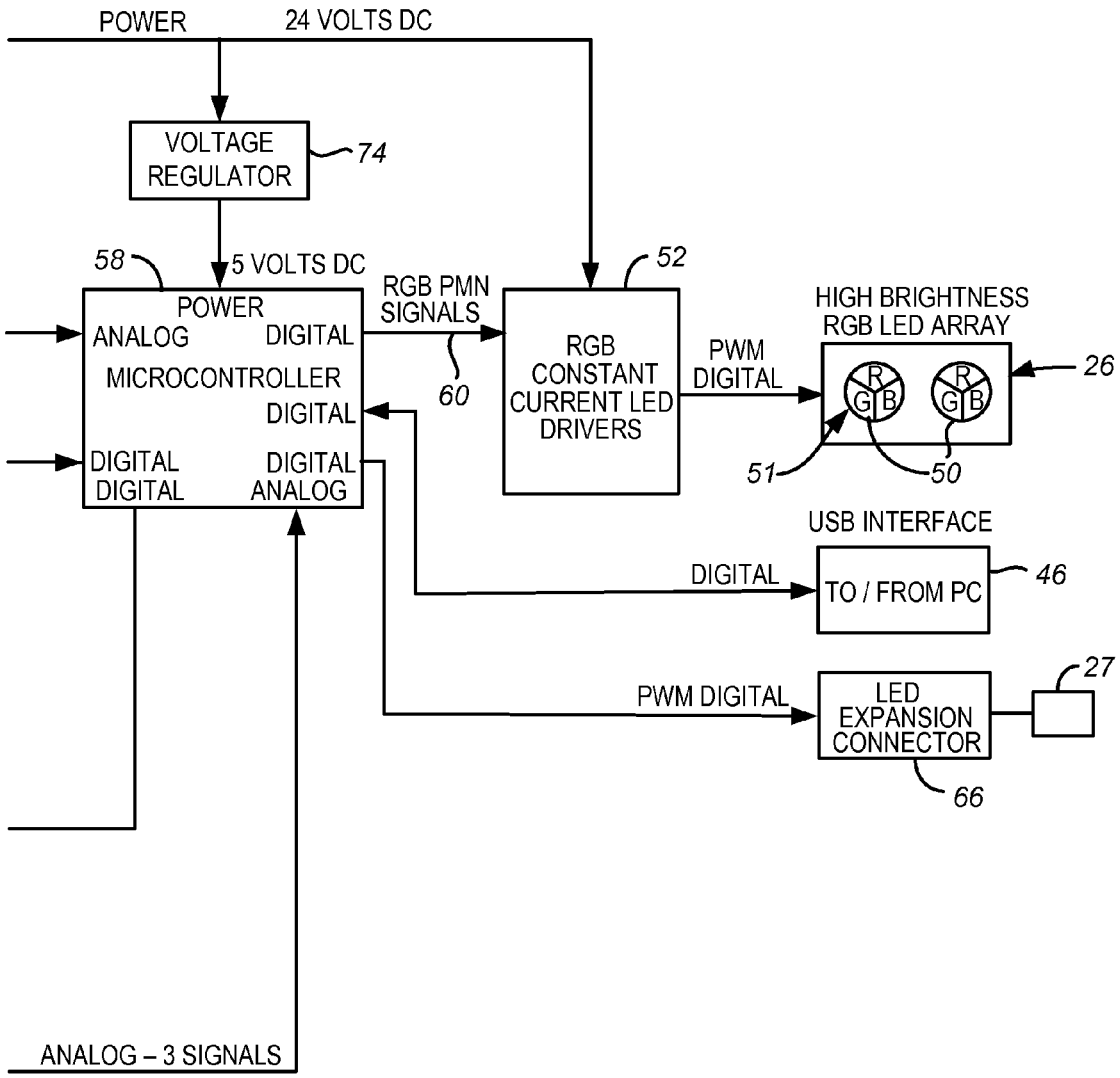

FIG. 3 is a simplified representation of the main components of lighting effect device 12 including a housing 20 having an upper surface 22 at which a number of components are found. A power switch 45, see FIG. 4, also referred to as on/off switch 45, is used to turn device 12 on and off. The mode switch 24 is a foot operated, push on-push off switch which allows the user to cycle through a number of different modes by successively pressing switch 24, discussed below. In some examples, the elements along the upper edge, that is from input jack 44 through guitar in jack 38, are not on upper surface 22 but rather are on a back wall of housing 20.

Mode 1: Color—The colored lighting options in this example are red, green, blue, and white. When mode 1 is selected, the color of lighting effect 14 is selected by using the foot operated, push on-push off color select switch 34. When the device 12 is first activated, the color can default to a particular color, such as red. An indicator LED 32 shows the user-selected color. The brightness of lighting effect 14 created by lamp 26 is chosen by a hand operated rotatable knob controlling a rotary switch, referred to as brightness/speed switch 30.

Mode 2: Instrument Input Effect—When selected, this mode causes the lighting effect 14 to be largely controlled by an output from the musical instrument, in this case guitar G. Housing 20 has a guitar in jack 38 from an output on guitar G, and a guitar out jack 39 for connection to a conventional amplifier/speaker system, not shown. When mode 2 is active, guitar LED indicator 40 is illuminated. In this mode microcontroller 58 causes switch 41 to connect guitar in, out jacks 38, 39 to volume control 48.

Mode 3: Strobe Effect—In this mode, device 12 can be triggered on/off in a strobe mode by the brightness switch 28 to produce a stroboscopic lighting effect 14 with, for example, regular colored flashes of light with varied discharge times. The discharge time, that is the rate of flashing per second, can be adjusted using brightness/speed switch 30. The color is selected by using the color select switch 34. The indicator LED 32 will pulse at the adjusted discharge rate with an intensity corresponding to the intensity of the light from LED array 51. The indicator led 32 flashes at the same rate as the high brightness (HB) LEDs 50. Both the HB LEDs 50 and indicator LED 32 are set to full brightness.

Mode 4: Christmas Tree Wheel Effect—Selection of this mode causes lighting effect 14 to cycle through the available colors, in this example red, green, blue and white. The speed of the cycling through the colors is controlled by the user using brightness/speed switch 30.

Mode 5: Audio Microphone Trigger Effect—When selected, the device 12 produces an adjustable colored lighting effect 14 triggered by external audio input captured by the built-in microphone 36. When this mode 5 is selected, microphone LED 54 is illuminated. The audio input captured by microphone 36 is directed through an internal bandpass filter within audio circuit 64 analyzing the external audio frequency and volume of the audio input. The indicator LED 32 shows the user-selected color. In this mode the hand operated, rotatable knob, referred to as volume control 48, is used to adjust the input level for best effect; volume control 48 is basically a sensitivity control in this mode 5. Mode 5, offers two selectable lighting effect sub-modes-1960's Color Organ Mode and User Mode. Each uses captured audio frequency and volume in a unique fashion.

1960's Color Organ Sub-Mode—Adjusting the brightness/speed switch 30 to the left selects this sub-mode when Mode 5 is selected. An internal bandpass filter with an audio circuit 64 analyzes the incoming audio and triggers a color and light intensity effect based on, in this example, three trigger frequencies and their relative input volumes. In this example, the three trigger frequencies and corresponding colors are: Blue 100 Hz, Green 1 KHz and Red 3 KHz.

User Sub-Mode—Adjusting the brightness/speed switch 30 to the right selects this sub-mode when Mode 5 is selected. The internal bandpass filter within audio circuit 64 analyzes the incoming audio from microphone 36 and triggers a user-selected color. Input volume detected through microphone 36 determines the intensity of the colored lighting effect. The indicator LED 32 shows the selected color.

Mode 6: Fader Effect—In this mode, device 12 produces colored lighting that fades in and out at varied speeds. The fade speed is hand adjusted using brightness/speed switch 30. The colored lighting options, as mentioned above, are in this example red, green, blue, and white. The color is selected by using the color select switch 34. The indicator LED 32 shows the user-selected color.

Mode 7: Audio Effects—In this mode, microcontroller 58 causes switch 41 to select the guitar in, out jacks 38, 39. When selected, the device 12 produces an adjustable colored lighting effect 14 triggered by input from a guitar or other instrument through guitar in, out jacks 38, 39. When this mode 7 is selected, guitar LED 40 is illuminated. The volume control 48 affects the selected input to allow the performer to adjust the input level for best effect; volume control 48 is basically a sensitivity control in this mode 7.

The mode numbers, that is the order of the effects, can be changed by reprogramming device 12. Some performers may want to eliminate some modes entirely so they can cycle through their desired modes faster.

The device 12 can be powered from an external power supply or internal, preferably rechargeable, batteries. An external power supply can be connected to device 12 by a power input jack 44. When device 12 includes internal rechargeable batteries, not shown, recharging can be through the input jack 44. Using an optional external rechargeable battery is well-suited for street artists such as jugglers and magicians who will find device 12 useful to enhance their un-plugged performances.

A USB interface 46 provides the user with external programming capability and the ability to perform to a user's unique effect scheme. The device 12 may be connected to, for example, a computing device, such as a personal computer, a tablet computer, or a so-called smart phone via a USB2 cable, not shown. Other types of cables and cable connections can also be used. In addition, connection can be through wireless means as well. Developmental software can be created to enable the user to adjust and save, for example, color, fading, strobe effect and effect duration schemes generated on the computer or generated during a performance. For example, settings can be derived on a computer at home then programmed into device 12 (which stores it in FLASH and EEPROM). Device 12 can then be disconnected from the computer and taken to for use at a performance with the settings preprogrammed Only the volume control setting cannot be programmed in this example. In other examples, it may be desired to have the ability to program volume control settings.

Lamp 26 includes an LED array 51 made including, in this example, two RGB LEDs 50 connected in series. Each LED 50 has three different colored LED chips in a single package with separate wires available for each color. The LEDs 50 currently used run on about 350 ma using about 20 W of power, although higher power ones could be used by changing the driver current. The constant current LED drive circuits 52 use switching power supply ICs to keep power dissipation low.

Microcontroller 58, in this example, has on-chip FLASH memory (for program storage), EEPROM (for user data storage) and SRAM (for program usage). Microcontroller 58 is the controller for the entire device 12, controlling the LED outputs and sampling all of the user controls. In this example, microcontroller 58 controls the LED array 51 using pulse width modulation (PWM). The PWM feature can be controlled by an 8-bit register for each of the 3 LED colors. That gives 256 levels of brightness for each color.

There are also three output pins corresponding to red, green and blue which drive a small RGB LED 32 as an indicator to the operator. LEDs 32 and 50 are either off or full on; no PWM is used. The microcontroller 58 samples the signal from brightness/speed switch 30 using an on-chip analog to digital converter. The converted input from switch 30 is filtered and averaged in software to give a steady value for the control. The on-chip analog to digital converter is also used to sample the 3 audio inputs corresponding to a high audio volume, medium audio volume and low audio volume for the beat/color organ function. The input levels of the signals from audio inputs are converted to an 8-bit value which is used to control the LED PWM signals 60, hence the brightness of LEDs 50. This is for both product software development and for user programming of light patterns, timing etc. Any number of modes can be programmed into device 12 and selected in sequence.

Overall Software

The software running on the microcontroller 58 determines how device 12 actually works. It samples the user controls (switches and brightness/speed control) and checks for changes. If any are found, they are executed, otherwise, the last selected mode is continued to be processed. There are two main functions in the software; the first is the main "LOOP" program which is continuously run. The second is the INTERRUPT functions. The interrupts only happen when a footswitch, specifically switches 24, 28, or 34, is activated, or when user data is received from the USB interface 46. They "interrupt" the main loop and are implemented immediately. Once a mode is selected, the microcontroller 58 continuously executes a loop which may change the output from the LEDs 50 based on a running timer. This is used when the strobe effect mode or the fader effect mode is selected. In the loop, the brightness/speed switch 30 is sampled and used to set the timer. This changes the strobe or fader speed. In the simple color mode, the timer is not used and the brightness/speed switch 32 is used for the LED brightness. If an interrupt comes from the microcontroller 58 through the USB interface 46, the user data is stored in EEPROM and used as parameters for the selected mode during the main program loop.

Overall Hardware

Power from an external adapter or battery is applied to power input jack 44. The voltage is commonly about 24 volts DC. Voltage regulator 74 supplies 5 V DC to microcontroller 58 while voltage regulator 76 supplies 5 V DC to the audio circuit 64, preventing digital noise from the rest of the board to affect the audio signals.

Microcontroller 58 can be, for example, Atmel ATMEGA32U4 or similar part. Its clock is supplied by a crystal, Y1, allowing for an accurate timer and serial interface baud rate (USB clock). Its program is stored microcontroller 58 in on-chip FLASH memory. Four of the analog inputs of microcontroller 58 are used. Three come from the audio amp and frequency splitter of circuit 64, and one from the brightness/speed switch 30. The three footswitches 28, 34 and 24 go to digital input pins of the microcontroller 58. These can generate interrupts in the microcontroller 58. Three digital out pins of microcontroller 58 are used to directly drive the indicator LED 32, sometimes referred to as the small RGB LED, in FIG. 4. This provides feedback to the user about the mode selected. Three more outputs, from pins connected to internal timers, are used as the PWM signals 60 to drive the high brightness LED array 51 (through their constant current LED drive circuits 52). An external LED array of supplemental lamp 27, shown in FIG. 1, is supplied PWM control signals through LED expansion socket 66 so that it can be driven in parallel with the on-product high brightness RGB LED array 51. This external LED array of supplemental lamp 27 will typically be have its own power supply and LED driver circuits to facilitate supplemental lamp 27 being of any size and brightness. Additional supplemental lamp 27 can also be used. The signal from microphone are amplified within circuit 64 to provide an audio signal to three bandpass filters within audio circuit 64. These three filters separate the audio into high, medium and low frequencies. Each filter is followed by a peak detector and an averaging filter to condition the signal for analog to digital conversion inside the microcontroller 58.

In Use

In use, device 12 can be used by musicians and performers seeking an elegant and simple performer-operated stage lighting system. In one example, the performer P arrives at a performance venue, such as a small club, with guitar G, amplifier (not shown) and pedal board 10, the pedal board including conventional music effect pedals 16 and lighting effect pedal 12. At an appropriate time during the performance, it may be time for a guitar solo. The performer taps the appropriate switches on device 12 with the performer's foot to trigger a lighting effect 14 typically the form of an upward flood of colored light emitted from lamp 26. The performer and the performance are now highlighted in a simple and unique way. When the guitar solo is finished, the performer can tap the device 12 to remove lighting effect 14. In some examples, a supplemental lighting effect 15 from supplemental lamp 27 may be created in addition to or instead of lighting effect 14.

Device 12 may be used alone, that is not mounted to a pedal board 10, or installed anywhere on a pedal board 10, and may be positioned in front of or at other positions adjacent to performer P.

Figure 5:
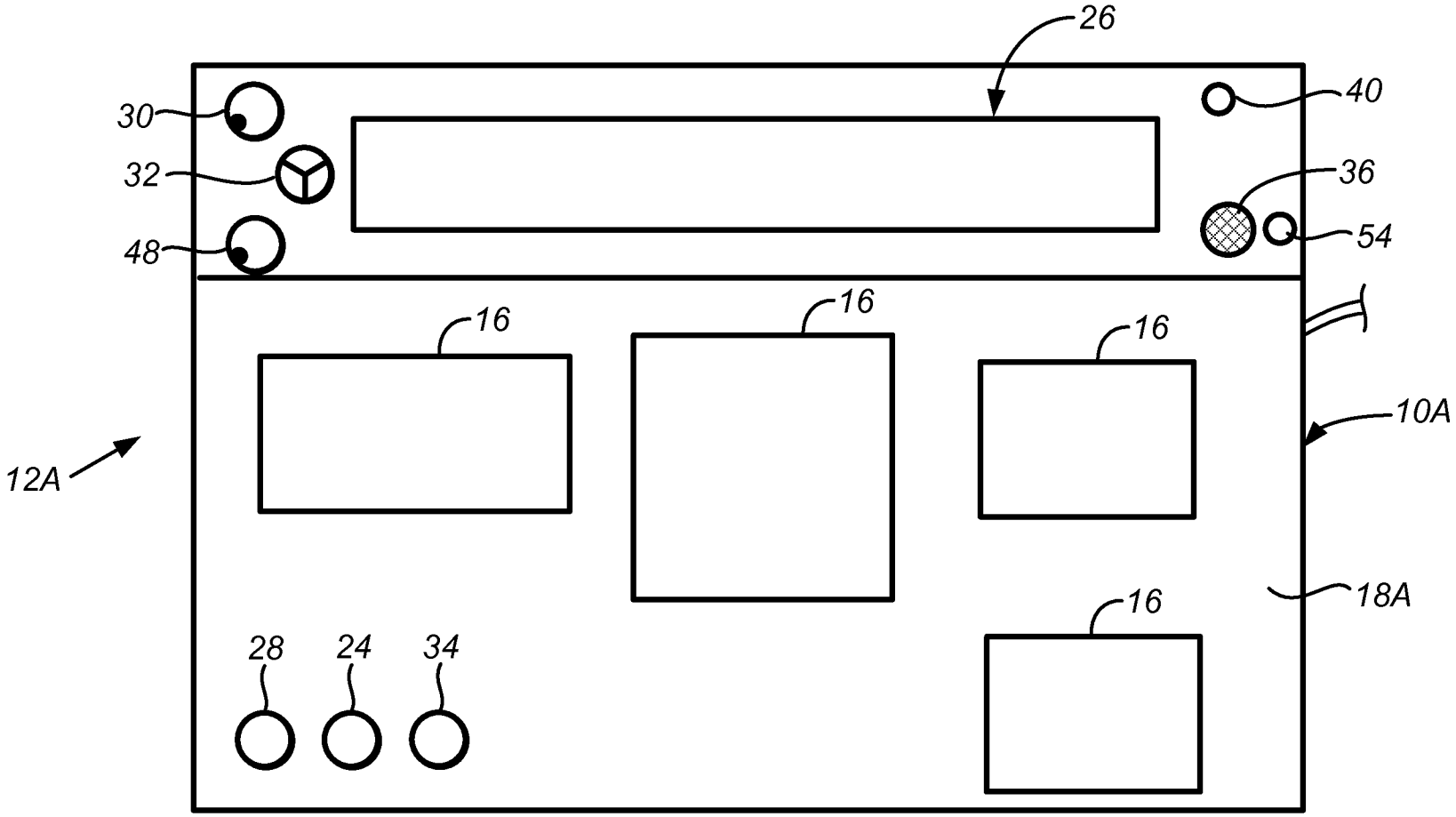
FIG. 5 is a top plan view of a pedal board with the lamp on the lighting effect device being an integral component of the pedal board.

FIG. 5 shows an example of a lighting effect device 12A made as an integral part of pedal board 10A. Pedal board 10A has an upper surface 18A on which audio effect pedals 16 can be mounted. In other examples, only lamp 26 can be made as an integral part of pedal board 10 with housing 20 and the rest of the components of device 12 being mounted to upper surface 18A of pedal board 10 via housing 20.

The device 12 may be used by, for example, singers, electric and acoustic guitar players, electric bass players, as well as string, brass and woodwind players. Device 12 can be used by a performer looking for a self-controlled, programmable, inexpensive, durable and easy to operate stage lighting solution. Since device 12 can be battery powered, street artists such as jugglers and magicians may also find this device useful to enhance their performance.

While the present invention is disclosed by reference to the preferred embodiments and examples detailed above, it is to be understood that these examples are intended in an illustrative rather than in a limiting sense. It is contemplated that modifications and combinations will occur to those skilled in the art, which modifications and combinations will be within the spirit of the invention and the scope of the following claims.

Any and all patents, patent applications and printed publications referred to above are incorporated by reference.

What is claimed is:

1. A method for providing a performer with a lighting effect in the form of upwardly directed illumination comprising:

placing the housing of a foot-actuated lighting effect device on a support surface at a location adjacent to an area where a performer will be during a performance, the foot-actuated lighting effect device comprising a lamp mounted to the housing for selectively creating an upwardly directed lighting effect on or near the performer, a performer-foot-actuated lighting switch connecting the lamp to a power source when the lighting switch is in an on state, a performer-foot-actuated lighting mode switch, and a performer-foot-actuated illumination-aspect-select switch, all three switches mounted to the housing, the lighting mode switch comprising a plurality of operational modes;

operating, by the performer using a foot of the performer, the lighting switch to place the lighting switch in the on state;

selecting, by the performer using a foot of the performer, an operational mode using the lighting mode switch;

operating, by the performer using a foot of the performer, the illumination-aspect-select switch according to a desired aspect of the upwardly directed illumination; and creating a lighting effect by the lamp, the lighting effect extending upwardly from the housing on or near the performer.

2. The method according to claim 1, wherein the illumination-aspect-select switch operating step is carried out to change the color of the light from the lamp.

3. The method according to claim 1, further comprising operating, by the performer, the mode switch allowing the performer to select at least the following operational modes: different colored lighting effects, a strobe lighting effect, a fader lighting effect, and a lighting effect affected by an audio signal.

4. The method according to claim 1, wherein the placing step is carried out with the lighting effect device being an integral part of a pedal board.

5. The lighting effect device according to claim 1, wherein the placing step is carried out with the support surface being a surface of a pedal board to which audio effect pedals are also mounted.

6. A user-foot-actuated performance lighting effect device, for use with a power source, comprising:

a housing;

a light-generating, multi-color lamp mounted to the housing;

a control circuit connectable to the power source, and including a user-foot-actuated lighting switch mounted to the housing, to control power to the control circuit to permit the lamp to be connected to the power source when the lighting switch is on;

a user-foot-actuated, color-select switch operably coupled to the multi-color lamp allowing a performer to select the color of light created by the multi-color lamp using his or her foot;

a user-foot-actuated mode switch operably coupled to the multi-color lamp allowing the performer to select from at least the following lighting effects: different colored lighting effects, a strobe lighting effect, a fader lighting effect, and a lighting effect affected by an audio signal to the control circuit;

the control circuit comprising a microcontroller providing lighting signals to the lamp according to inputs to the microcontroller from at least the color-select switch and the mode switch;

the control circuit comprising a musical instrument input jack;

the microcontroller comprising a musical instrument input coupled to the musical instrument input jack so that the electronic audio signals applied to the musical instrument input affects the lighting signals provided by the microcontroller to the lamp;

the control circuit comprising an internal microphone;

the microcontroller comprising an internal microphone input coupled to the internal microphone so that the electronic audio signals applied to the internal microphone input affects the lighting signals provided by the microcontroller to the lamp; and the lamp creating a lighting effect extending upwardly from the housing when the lighting switch is on.

* * * * *